US006431832B1

(12) United States Patent
Glezer et al.

(10) Patent No.: US 6,431,832 B1
(45) Date of Patent: Aug. 13, 2002

(54) GAS TURBINE ENGINE AIRFOILS WITH IMPROVED COOLING

(75) Inventors: Boris Glezer; Hee Koo Moon, both of San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 09/689,058

(22) Filed: Oct. 12, 2000

(51) Int. Cl.[7] ..... B64C 11/24; F01D 5/18
(52) U.S. Cl. ..... 416/97 R
(58) Field of Search ..... 415/115; 416/97 R

(56) References Cited

U.S. PATENT DOCUMENTS 4,474,532 A * 10/1984 Pazder ..... 416/97 R
4,738,587 A * 4/1988 Kildea ..... 416/97 R X
4,753,575 A * 6/1988 Levengood et al. ..... 416/97 R
5,246,340 A * 9/1993 Winstanley et al. ..... 416/97 R
5,356,265 A * 10/1994 Kercher ..... 416/97 R
5,603,606 A 2/1997 Glezer et al.
5,857,837 A 1/1999 Zelesky et al.
5,931,638 A * 8/1999 Krause et al. ..... 416/97 R
6,036,441 A * 3/2000 Manning et al. ..... 416/97 R
6,039,537 A 3/2000 Scheurlen
6,168,381 B1 * 1/2001 Reddy ..... 416/97 R
6,206,638 B1 * 3/2001 Glynn et al. ..... 416/97 R

* cited by examiner

*Primary Examiner*—John E. Ryznic
(74) *Attorney, Agent, or Firm*—Keith P. Roberson

(57) ABSTRACT

Cooling air delivery systems for gas turbine engines are used to increase component life and increase power and efficiencies. The present system increases the component life and increases efficiencies by better utilizing the cooling air bled from the compressor section of the gas turbine engine. For example, a first portion of cooling fluid cools the leading edge of a turbine blade internally. After first contacting a predetermined area of the component, a portion of that first portion of cooling fluid is then used to film cool the component.

16 Claims, 5 Drawing Sheets

GAS TURBINE ENGINE AIRFOILS WITH IMPROVED COOLING

TECHNICAL FIELD

This invention relates generally to a gas turbine engine cooling and more particularly to cooling of airfoils such as turbine blades and nozzles.

BACKGROUND ART

High performance gas turbine typically rely on increasing turbine inlet temperatures to increase both fuel economy and overall power ratings. These higher temperatures, if not compensated for, oxidize engine components and decrease component life. Component life has been increased by a number of techniques.

Many solutions to improved components involve changing materials used in fabricating the components. U.S. Pat. No. 653,579 issued to Glezer et al on Aug. 5, 1997 shows a turbine blade made of a ceramic material. Other systems instead use a coating to protect a metal turbine blade as shown in U.S. Pat. No. 6,039,537 issued to Scheurlen on Mar. 21, 2000.

Even improved materials typically require further cooling. Most components include a series of internal cooling passages. Conventionally, a portion of the compressed air is bled from an engine compressor section to cool these components. To maintain the overall efficiency of the gas turbine, only a limited mass of air from the compressor section may be used for cooling. U.S. Pat. No. 5,857,837 issued to Zelesky et al on Jan. 12, 1999 shows an air foil having impingement jets to increase heat transfer. Impingement cooling creates high local heat transfer coefficients so long as spent cooling air may be effectively removed to prevent building a boundary layer of high temperature spent cooling air. Typically removal of spent cooling air is through a series of discharge holes located along the leading edge of the turbine blade. These systems require relatively high masses of cooling air. Further, plugging of the leading edge discharge holes may lead to a reduction of cooling and ultimately failure of the turbine blade.

Due to the limited mass of cooling air available and need to reduce pressure loss, component design requires optimal use of available cooling air. Typically, hot spots occur near a leading edge of a component. U.S. Pat. No. 5,603,606 issued to Glezer et al on Feb. 18, 1997 shows a cooling system that induces vortex flows in the cooling fluid near the leading edge of the component to increase heat transfer away from the component into the cooling fluid. The cooling flow in this system is limited by the size of the downstream openings in the turbine blade or component.

The present invention is directed to overcome one or more of the problems as set forth above.

DISCLOSURE OF THE INVENTION

In one aspect of the current invention an air foil has a leading edge and trailing edge. A first gallery is disposed internally in the air foil near the leading edge. A second radial gallery is disposed between a peripheral wall of the air foil and the first gallery. The second gallery is in fluid communication with the first gallery. A film cooling gallery is disposed internally of the peripheral wall proximate the leading edge. The film cooling gallery is fluidly connected with the second gallery and has a plurality of openings extending through the peripheral wall.

In another aspect of the present invention a method of cooling an air foil requires supplying a first portion of cooling fluid through a plurality of holes into a gallery adjacent an inner surface of a peripheral wall proximate a leading edge of a air foil. A film portion of the first portion of cooling fluid is transferred to a film cooling gallery. The film cooling gallery is connected to an outer surface of the peripheral wall near the leading edge (150).

BEST MODE FOR CARRYING OUT THE INVENTION

Figure 1:
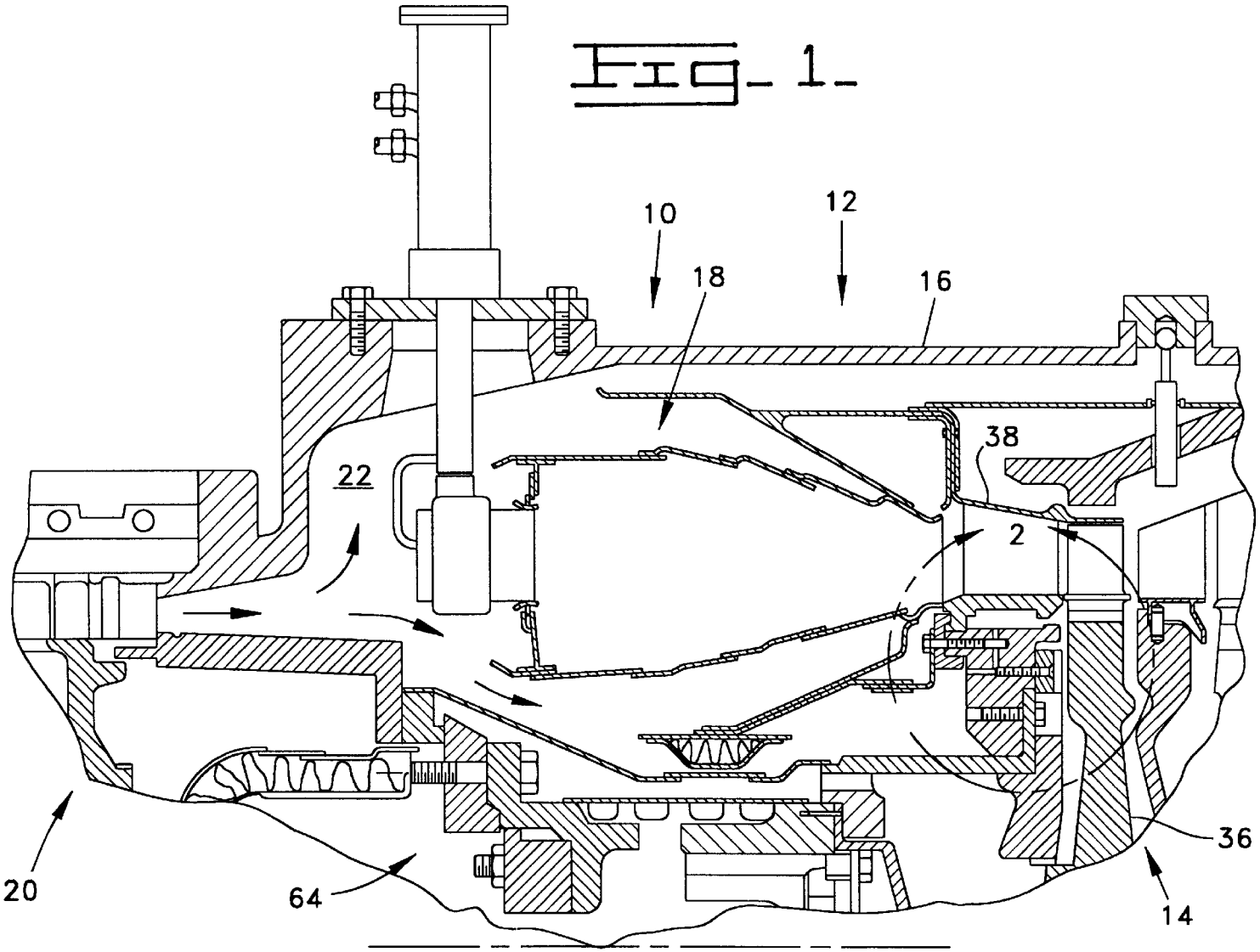
FIG. 1 is a sectional side view of a portion of a gas turbine engine embodying the present invention.

Referring to FIG. 1, a gas turbine engine 10, not shown in its entirety, has been sectioned to show a cooling air delivery system 12 for cooling components of a turbine section 14 of the engine. The engine 10 includes an outer case 16, a combustor section 18, a compressor section 20, and a compressor discharge plenum 22 fluidly connecting the air delivery system 12 to the compressor section 20. The compressor section 20, in this application, is a multistage axial compressor although only a single stage is shown. The combustor section 18 connects between the compressor section 20 and turbine section in a conventional manner. While the current combustor section 18 is shown in as annular, other combustor schemes may also work in this application. The turbine section 14 includes a first stage turbine 36 disposed partially within an integral first stage nozzle and shroud assembly 38. The cooling air delivery system 12, for example, has a fluid flow path 64 interconnecting the compressor discharge plenum 22 with the turbine section 14.

Figure 2:
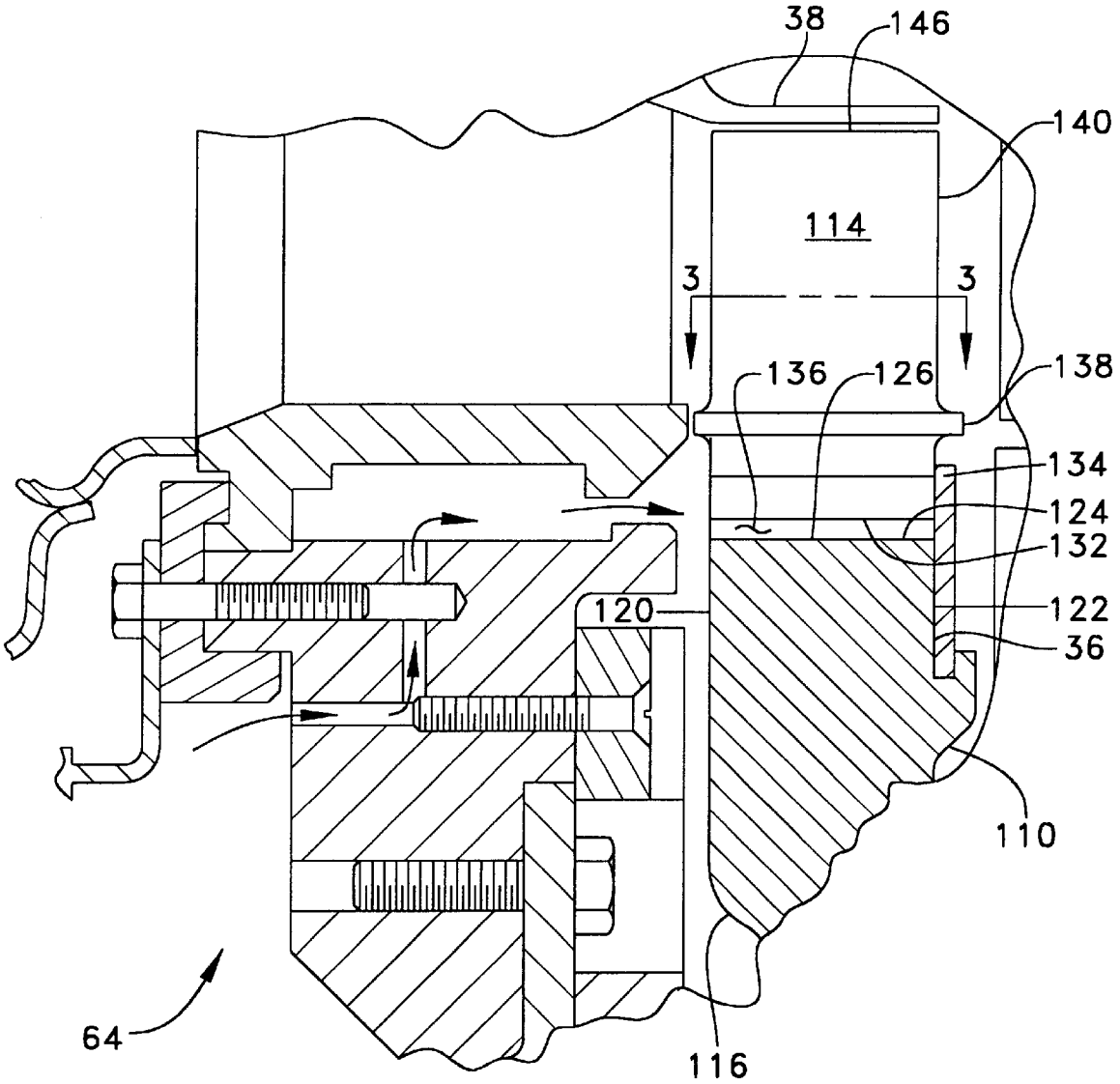
FIG. 2 is an enlarged sectional view of a portion of FIG. 1 taken along lines 2—2 of FIG. 1.

As best shown in FIG. 2, the turbine section 14 is of a generally conventional design. For example, the first stage turbine 36 includes a rotor assembly 110 disposed axially adjacent the nozzle and shroud assembly 38. The rotor assembly 110 is generally of conventional design and has a plurality of turbine blades 114 positioned therein. Each of the turbine blades 114 are made of any conventional material such as a metallic alloy or ceramic material. The rotor assembly 110 further includes a disc 116 having a first face 120 and a second face 122. A plurality of circumferentially arrayed retention slots 124 are positioned in the disc 116. Each of the slots 124, of which only one is shown, extends from one face 120 to the other face 122, has a bottom 126 and has a pair of side walls (not shown) which are undercut in a conventional manner. The plurality of blades 114 are replaceably mounted within the disc 116. Each of the plurality of blades 114 includes a first end 132 having a root section 134 extending therefrom which engages with one of the corresponding slots 124. The first end 132, or platform, is spaced away from the bottom 126 of the slot 124 in the disc 116 and forms a gallery 136. Each blade 114 has a platform section 138 disposed radially outwardly from the periphery of the disc 116 and the root section 134. Extending radially outward from the platform section 138 is a reaction section 140. Each of the plurality of turbine blades 114 includes a second end 146, or tip, positioned opposite the first end 132 and adjacent the reaction section 140.

Figure 3:
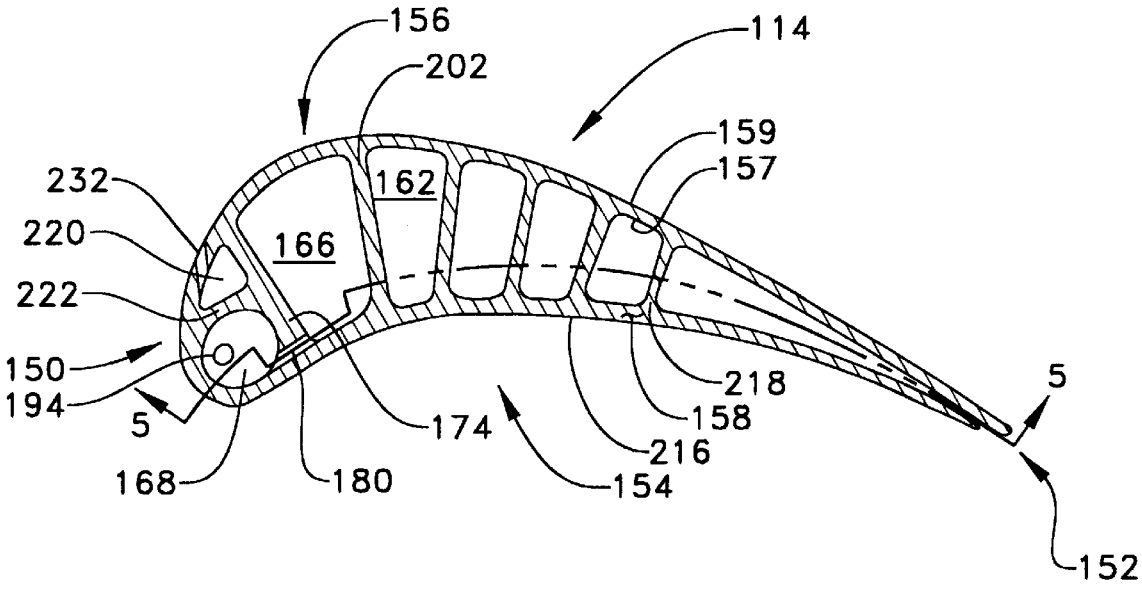
FIG. 3 is an enlarged sectional view of a turbine blade taken along lines 3—3 of FIG. 2.
Figure 4:
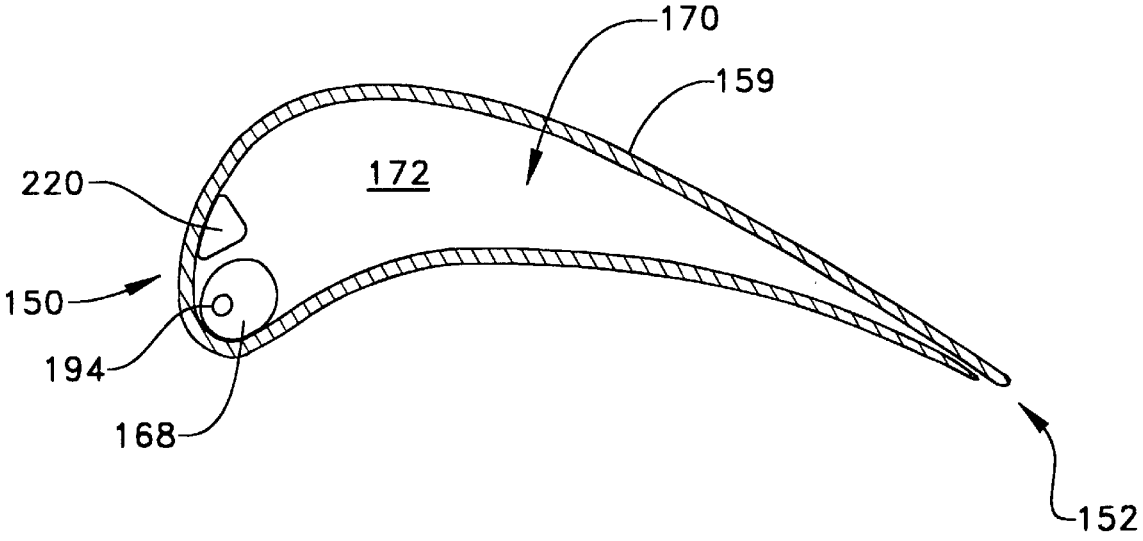
FIG. 4 is an enlarged sectional view of the turbine blade taken along lines 4—4 of FIG. 5.

As is more clearly shown in FIGS. 3, 4, and each of the plurality of turbine blades 114 includes a leading edge 150 which, in the assembled condition, is positioned adjacent the nozzle assembly 38 and a trailing edge 152 positioned opposite the nozzle assembly 38. Interposed the leading edge 150 and the trailing edge 152 is a pressure or concave side 154 and a suction or convex side 156. Each of the plurality of blades 114 has a generally hollow configuration forming a peripheral wall 158 having a generally uniform thickness, an inner surface 157, and exterior surface 159.

A plurality of blade cooling passages are formed within the peripheral wall 158. In this application the plurality of blade cooling passages includes a first cooling path 160. However, any number of cooling paths could be used without changing the essence of the invention.

The first cooling path 160 is positioned within the peripheral wall 158 and is interposed the leading edge 150 and the trailing edge 152 of each of the blades 114. The first cooling path 160 includes an inlet opening 164 originating at the first end 132 and has a first radial gallery 166 or plenum extending outwardly substantially the entire length of the blade 114 toward the second end 146. The inlet opening 164 and the first radial gallery 166 are interposed the leading edge 150 and the trailing edge 152.

Further included in the first cooling path 160 is a second radial gallery 168 extending between the first end 132 and the second end 146. The second radial gallery 168 fluidly communicates with a tip gallery 170 at least partially interposed the second end 146 and the first radial gallery 166 by a first partition 172 which is connected to the peripheral wall 158 at the concave side 154 and the convex side 156. The second radial gallery 168 is interposed the leading edge 150 and the first radial gallery 166 by a second partition 174. The second partition 174 extends between the first end 132 and second end 146 and connects to the peripheral wall 158 at the concave side 154 and the convex side 156. The second radial gallery 168 has an end 176 adjacent the first end 132 of the blade 114 and is opposite the end communicating with the tip gallery 170. The tip gallery 170 communicates with an exit opening 178 disposed in the trailing edge 152. A plurality of holes or slots 180 are positioned in the second partition 174 and communicate between the first radial gallery 166 and the second radial gallery 168. As shown in FIGS. 3, the plurality of holes 180 are positioned adjacent the peripheral wall 158 near the pressure side 154 of each of the blades 114. In this application, the plurality of holes 180 extend from about the platform section 138 to about the first partition 172. While the plurality of holes 180 are shown as being perpendicular to the second partition 174, the plurality of holes may be formed at various angles with the second partition 174. As an alternative, an additional angled passage 194 extends between the first radial gallery 166 and the second radial gallery 168. The angled passage 194 enters the second radial passage 168 at an angle of about 30 to 60 degrees near the end 176 of the second radial gallery 168.

Figure 5:
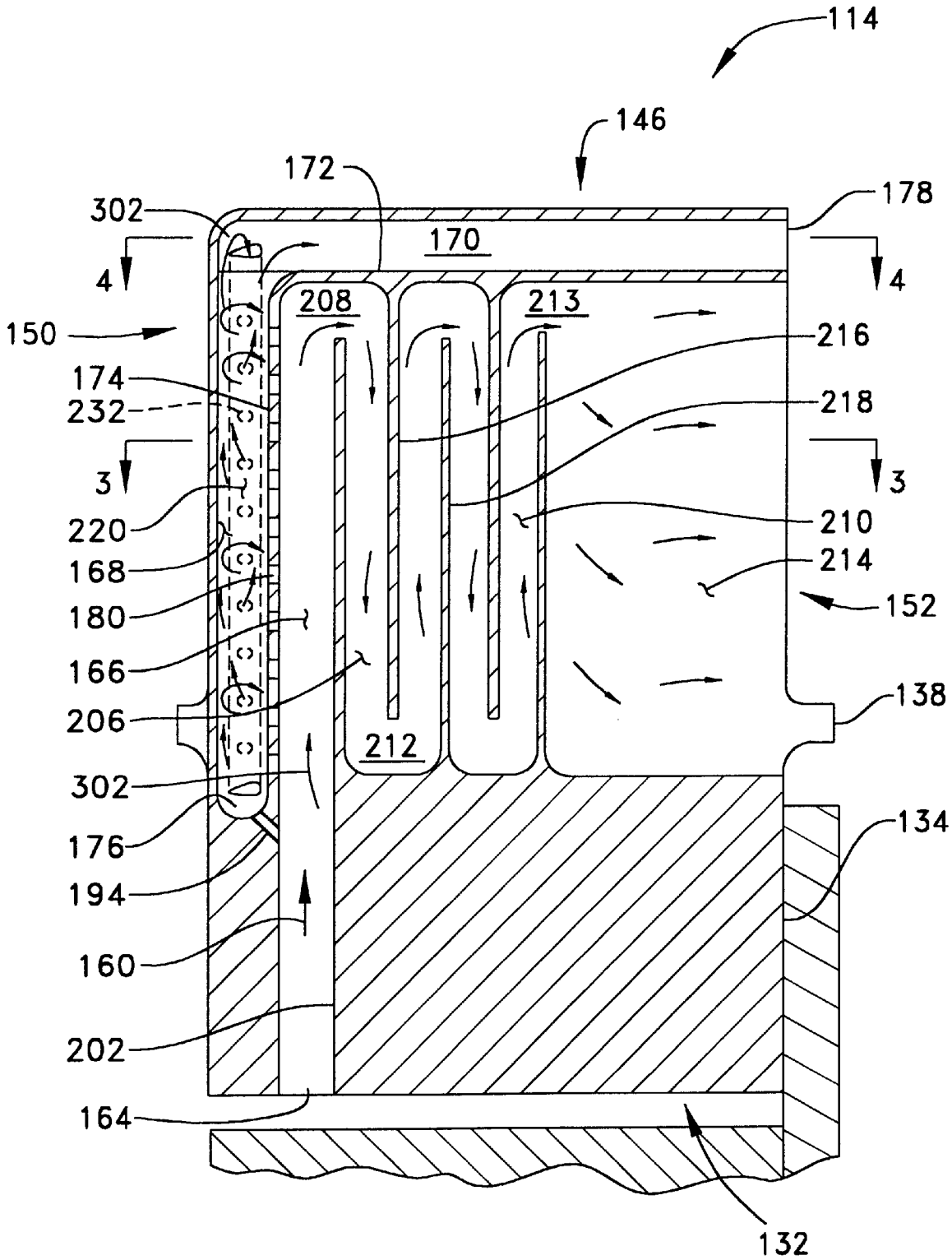
FIG. 5 is an enlarged sectional view of the turbine blade taken along lines 5—5 of FIG. 3.
Figure 6:
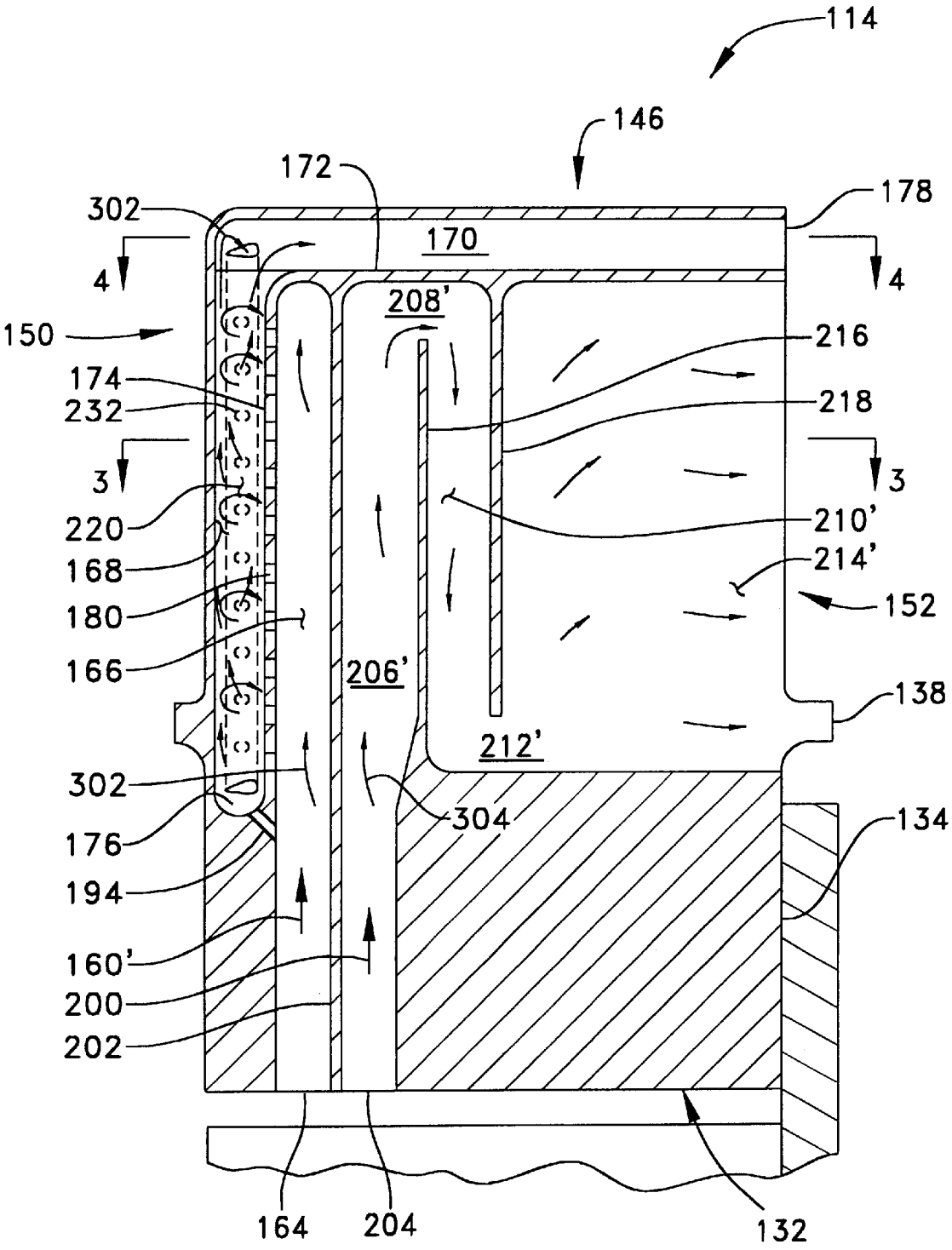
FIG. 6 is an alternative embodiment of the turbine blade taken along lines 5—5 of FIG. 3.

As an alternative, FIG. 6 shows a second cooling path 200 positioned within the peripheral wall 158 and is interposed the first cooling path 160' and the trailing edge 152 of each blade 114 (where "'" represent variations from FIG. 5). The second cooling path 200 is separated from the first cooling path 160' by a first wall member 202. The second cooling path 200 includes an inlet opening 204 originating at the first end 132.

In FIG. 5, a first turning passage 208 positioned inwardly of the tip gallery 170 of the first cooling path 160 and is in communication with a first radial passage 206. A second turning passage 212 connects the first radial passsage with a second radial passage 210. A third turning passage 213 connects the second radial passage 210 with a radial outlet passage 214. The first radial passage 206 is separated from the second radial passage 210 by a second wall member 216 which is connected to the peripheral wall 158 at the concave side 154 and the convex side 156. The second radial passage 210 is separated from the radial outlet passage 214 by a third wall member 218 which is also connected to the peripheral wall 158 at the concave side 154 and the convex side 156.

The alternative shown in FIG. 6 show the first turning passage 208' connecting the first radial passage 206' and second radial passage 210'. The second turning passage 212' now connects the second radial passage 210' to the radial outlet passage 214' near the platform section 138. While this application shows two radial passages 206' and 210', selection of appropriate number of radial passages is a matter of design choice and will change depending on application.

In this application, the turbine blade 114 further includes a film cooling gallery 220 positioned near the leading edge 150. A film cooling partition 222 connects between the second partition and some location on the peripheral wall 158 adjacent the leading edge 150. The film cooling partition 222 extends radially between the tip gallery 170 and the platform section 138 defining the film cooling gallery 220. Near the second end 146, the film cooling gallery 220 fluidly connects with the tip gallery 170 as best shown in FIGS. 4 and 5. Optionally, the film cooling gallery 220 may also fluidly connect with the second radial gallery 168 near the end 176. A plurality of openings 232, of which only one is shown, have a preestablished area and communicates between the film cooling gallery 220 and the suction side 156 of the blade 114. For example, the preestablished area of the plurality of openings 232 is about 50 percent of the preestablished cross-sectional area of the film cooling plenum 168. The plurality of openings 232 exit the suction side 156 at an incline angle generally directed from the leading edge 150 toward the trailing edge 152. A preestablished combination of the plurality of holes 232 having a preestablished area forming a flow rate and the plurality of holes 180 having a preestablished area forming a flow rate provides an optimized cooling effectiveness for the blade 114.

The above description is of only the first stage turbine 36; however, it should be known that the construction could be generally typical of the remainder of the turbine stages within the turbine section 14 should cooling be employed. Furthermore, although the cooling air delivery system 12 has been described with reference to a turbine blade 114 the system is adaptable to any airfoil such as the first stage nozzle and shroud assembly 38 without changing the essence of the invention.

Industrial Applicability

In operation, the reduced amount of cooling fluid or air from the compressor section 20 as used in the delivery system 12 results in an improved efficiency and power of the gas turbine engine 10 while increasing the longevity of the components used within the gas turbine engine 10. The following operation will be directed to the first stage turbine 36; however, the cooling operation of the remainder of the airfoils (blades and nozzles) could be very similar if cooling is used. After exiting the compressor, the cooling air enters into the gallery 136 or space between the first end 132 of the blade 114 and the bottom 126 of the slot 124 in the disc 116.

A first portion of cooling fluid 300 enters the first cooling path 160. For example, the first portion of cooling fluid 300 enters the inlet opening 164 and travels radially along the first radial gallery 166 absorbing heat from the peripheral wall 158 and the partition 172. The majority of the first portion of cooling fluid exits the first radial gallery 166 through the plurality of holes 180 and creates a swirling flow which travels radially along second radial gallery 168 absorbing of heat from the leading edge 150 of the peripheral wall 158. The first portion of cooling fluid 300 generates a vortex flow in the second radial gallery 168 due to its interaction with the plurality of holes 180 and the angled passage 194. The first portion of cooling fluid 300 entering the angled passage 194 between the first radial gallery 166 and the second radial gallery 168, as stated above, adds to the vortex flow by directing the cooling fluid 66 generally radially outward from second radial gallery 168 into the tip gallery 170.

As the first portion of cooling fluid 300 enters the tip gallery 170 from the second radial gallery 168, a portion of the first portion of cooling fluid 300 or film portion of cooling fluid 302 is drawn into the film cooling gallery 220. The plurality of openings 232 expose the film cooling gallery 222 to lower air pressures than those present in the tip gallery 170 allowing the portion of cooling fluid to be drawn into the film cooling plenum 220. The film portion of cooling fluid 302 exits the plurality of openings 232 cooling the exterior surface 159 of the peripheral wall 158 in contact with combustion gases on the suction side 156 prior to mixing with the combustion gases. The remainder of the cooling fluid 66 in the first cooling path 162 exits the exit opening 178 in the trailing edge 152 to also mix with the combustion gases.

A shown in FIG. 6, a second portion of the cooling fluid 304 enters the second cooling path 200. For example, cooling fluid 66 enters the inlet opening 204 and travels radially along the first radial passage 206 absorbing heat from the peripheral wall 158, the first wall member 202 and the second wall member 216 before entering the first turning passage 208' where more heat is absorbed from the peripheral wall 158. As the second portion of cooling fluid 304 enters the second radial passage 210' additional heat is absorbed from the peripheral wall 158, the first wall member 202 and the second wall member 216 before entering the second turning passage 212' and exiting the radial outlet passage 214' along the trailing edge 152 to be mixed with the combustion gases.

The improved turbine cooling system 12 provides a more efficient use of the cooling air bled from the compressor section 20, increase the component life and efficiency of the engine. Adding the film cooling gallery 220 allows the first portion of cooling fluid 300 to contact more of the second radial gallery prior 168 prior to exiting the plurality of holes 232 for use in film cooling.

Other aspects, objects and advantages of this invention can be obtained from a study of the drawings, the disclosure and the appended claims.

What is claimed is:

1. An air foil for use in a gas turbine engine, said air foil having a leading edge, a trailing edge, a pressure side, a suction side, a peripheral wall having an inner surface and an outer surface, said air foil comprising:

a first radial gallery disposed internally of said peripheral wall proximate said leading edge, said first radial gallery extending between a first end and a second end of said air foil;

a second radial gallery being disposed between said peripheral wall and said first radial gallery, said second radial gallery extending between said first end and said second end, a partition between said first radial gallery and said second radial gallery defining a plurality of holes, said plurality of holes allowing fluid communication between said first radial gallery and said second radial gallery;

a film cooling gallery disposed internally of said peripheral wall proximate said leading edge, said film cooling gallery extending between said second end and said first end, said film cooling gallery being fluidly connected with said second radial gallery, said film cooling gallery having a plurality of openings extending between said inner surface and said outer surface of said peripheral wall; and an angled passage proximate said first end, said angled passage fluidly connecting said first radial gallery with said second radial gallery.

2. The air foil of claim 1 further comprising a tip gallery disposed internally of said peripheral wall, said tip gallery being between said leading edge and said trailing edge proximate said second end, said tip gallery fluidly connecting said second radial gallery with said film cooling gallery proximate said second end.

3. The air foil of claim 1 wherein said plurality of holes being adjacent a pressure side of said air foil.

4. An air foil for use in a gas turbine engine, said air foil having a leading edge, a trailing edge, a pressure side, a suction side, a peripheral wall having an inner surface and an outer surface, said air foil comprising:

a first radial gallery disposed internally of said peripheral wall proximate said leading edge, said first radial gallery extending between a first end and a second end of said air foil;

a second radial gallery being disposed between said peripheral wall and said first radial gallery, said second radial gallery extending between said first end and said second end, said second radial gallery being in fluid communication with said first radial gallery;

a film cooling gallery disposed internally of said peripheral wall proximate said leading edge, said film cooling gallery extending between said second end and said first end, said film cooling gallery being fluidly connected with said second radial gallery, said film cooling gallery having a plurality of openings extending between said inner surface and said outer surface of said peripheral wall; and a tip gallery disposed internally of said peripheral wall, said tip gallery positioned between said leading edge and said trailing edge proximate said second end, said tip gallery fluidly connecting said second radial gallery with said film cooling gallery proximate said second end.

5. The air foil of claim 1 further comprising an angled passage fluidly connecting said first radial gallery with said second radial gallery.

6. The air foil of claim 2 wherein said angled passage is proximate said first end.

7. The air foil of of claim 1 wherein said first radial gallery and said second radial gallery are connected by a plurality of holes in a partition separating said first radial gallery and said second radial gallery.

8. The air foil of claim 7 wherein said plurality of holes are disposed proximate said pressure side, said plurality of holes being adapted to create a vortex flow.

9. The air foil of claim 1 further comprising a first radial passage disposed internally of said peripheral wall between said trailing edge and said first cooling gallery.

10. The air foil of claim 9 wherein said first radial passage being connectable with said first radial gallery.

11. The air foil of claim 1 wherein said air foil is a turbine blade.

12. A method of cooling an air foil for a gas turbine engine comprising the steps:

supplying a first portion of a cooling fluid through a plurality of holes into a radial gallery adjacent an inner surface of a peripheral wall proximate a leading edge of said air foil;

transferring a film portion of said first portion of said cooling fluid to a tip gallery;

transferring said film portion from said tip gallery to a film cooling gallery; and connecting said film cooling gallery with an outer surface of said peripheral wall proximate said leading edge.

13. The method of cooling of claim 12 further comprising the step of inducing a vortex flow in said radial gallery.

14. The method of cooling of claim 12 wherein said transferring step is proximate said first end of said air foil.

15. The method of cooling of claim 12 further comprising the step of supplying a second portion of cooling fluid internal of said air foil downstream of said leading edge.

16. The method of cooling of claim 15 wherein said second portion of cooling fluid is said first cooling portion less said film cooling portion.

* * * * *